US005958195A

United States Patent [19]

Lorincz et al.

[11] Patent Number: 5,958,195

[45] Date of Patent: Sep. 28, 1999

[54] TUBE INNER SURFACE ELECTROPOLISHING DEVICE

[75] Inventors: Thomas A. Lorincz, Hollister; Joseph P. Parisi, San Jose, both of Calif.

[73] Assignee: Therma Corporation, Inc., San Jose, Calif.

[21] Appl. No.: 08/862,148

[22] Filed: May 22, 1997

[51] Int. Cl.[6] ..... C25F 7/00

[52] U.S. Cl. ..... 204/224 M; 204/225; 204/272; 204/280

[58] Field of Search ..... 204/224 M, 225, 204/272, 280

[56] References Cited

U.S. PATENT DOCUMENTS

| | | | |
|---|---|---|---|
| 2,764,540 | 9/1956 | Farin et al. | 204/272 X |
| 4,369,101 | 1/1983 | Wolff et al. | 204/272 X |
| 4,645,581 | 2/1987 | Voggenthaler et al. | 204/275 |
| 4,772,367 | 9/1988 | Menzel et al. | 204/272 X |
| 4,826,582 | 5/1989 | Lavalerie et al. | 204/224 M |
| 5,507,923 | 4/1996 | Stouse et al. | 204/272 X |

*Primary Examiner*—Donald R. Valentine
*Attorney, Agent, or Firm*—Robert O. Guillot

[57] ABSTRACT

The tube inner surface electropolishing device includes an electrolyte delivery system to cause electrolyte to flow through the tube whose inner surface must be electropolished. An electrical cable having an electrode engaged to its distal end is slowly moved through the tube while an electrical current from a power supply passes through the electrode and the tube wall and the electrolyte flowing therebetween. Several electrode embodiments are disclosed including electrodes that include a chain of elements having alternating insulator and electrode elements, an electrode including a quantity of metallic wool enclosed in a permeable insulating member, and a flexible insulating member formed from a cylindrical tubular section which is axially compressible to produce a series of projecting flexible arms, so that any one section can be compressed to enter a smaller opening than the tube to be polished.

18 Claims, 5 Drawing Sheets

TUBE INNER SURFACE ELECTROPOLISHING DEVICE

BACKGROUND OF THE INVENTION

1. Field of the Invention

The present invention relates generally to devices for electropolishing the inner surface of metal tubes and more particularly to such devices which utilize flexible electrodes drawn through the tube.

2. Description of the Prior Art

Metal tubing that is to be utilized in high purity applications is preferably cleaned by electropolishing prior to installation. Additionally, subsequent to installation, metal tubing utilized in many industrial applications may be attacked on the inner tubular surfaces by chemicals passing through the tubing. This may result in the need to replace the tubing, at great cost. Significant cost savings can be accomplished in many industrial equipment applications, if the interior surface of the metal tubing can be cleaned, such that the tubing can be reused.

Prior art devices are known that can clean the inner surface of straight tubing sections; however, tubing with a plurality of bends can pose a difficult problem. One such prior art device is described in U.S. Pat. No. 4,645,581, Apparatus for Electropolishing the Inner Surface of U-shaped Heat Exchanger Tubes, issued Feb. 24, 1987 to Voggenthaler et al. The present invention provides improved results.

SUMMARY OF THE INVENTION

The tube inner surface electropolishing device includes an electrolyte delivery system to cause electrolyte to flow through the tube whose inner surface must be electropolished. An electrical cable having an electrode engaged to its distal end is slowly moved through the tube while an electrical current from a power supply passes through the electrode and the tube wall and the electrolyte flowing therebetween. Several electrode embodiments are disclosed including electrodes that include a chain of elements having alternating insulator and electrode elements, an electrode including a quantity of metallic wool enclosed in a permeable insulating member, and a flexible insulating member formed from a cylindrical tubular section which is axially compressible to produce a series of projecting flexible arms. The various electrode embodiments generally function such that the insulator members prevent electrically powered electrode elements from touching the sidewall and producing an electrical short.

It is an advantage of the present invention that metal tubular components having a plurality of bends can be effectively, economically electropolished.

It is another advantage of the present invention that electrode embodiments are disclosed which are easy to manufacture and utilize.

It is a further advantage of the present invention that the various electrode embodiments are flexible to pass through a plurality of bends in a tubular member, such that complex tubular configurations can be effectively electropolished.

It is yet another advantage of the present invention that it provides an electrode embodiment that is compressible to allow it to pass through smaller openings, and then expand to process generally larger tubing.

These and other features and advantages of the present invention will be well understood by those skilled in the art upon review of the following detailed description.

IN THE DRAWINGS

DETAILED DESCRIPTION OF THE PREFERRED EMBODIMENTS

Figure 1:
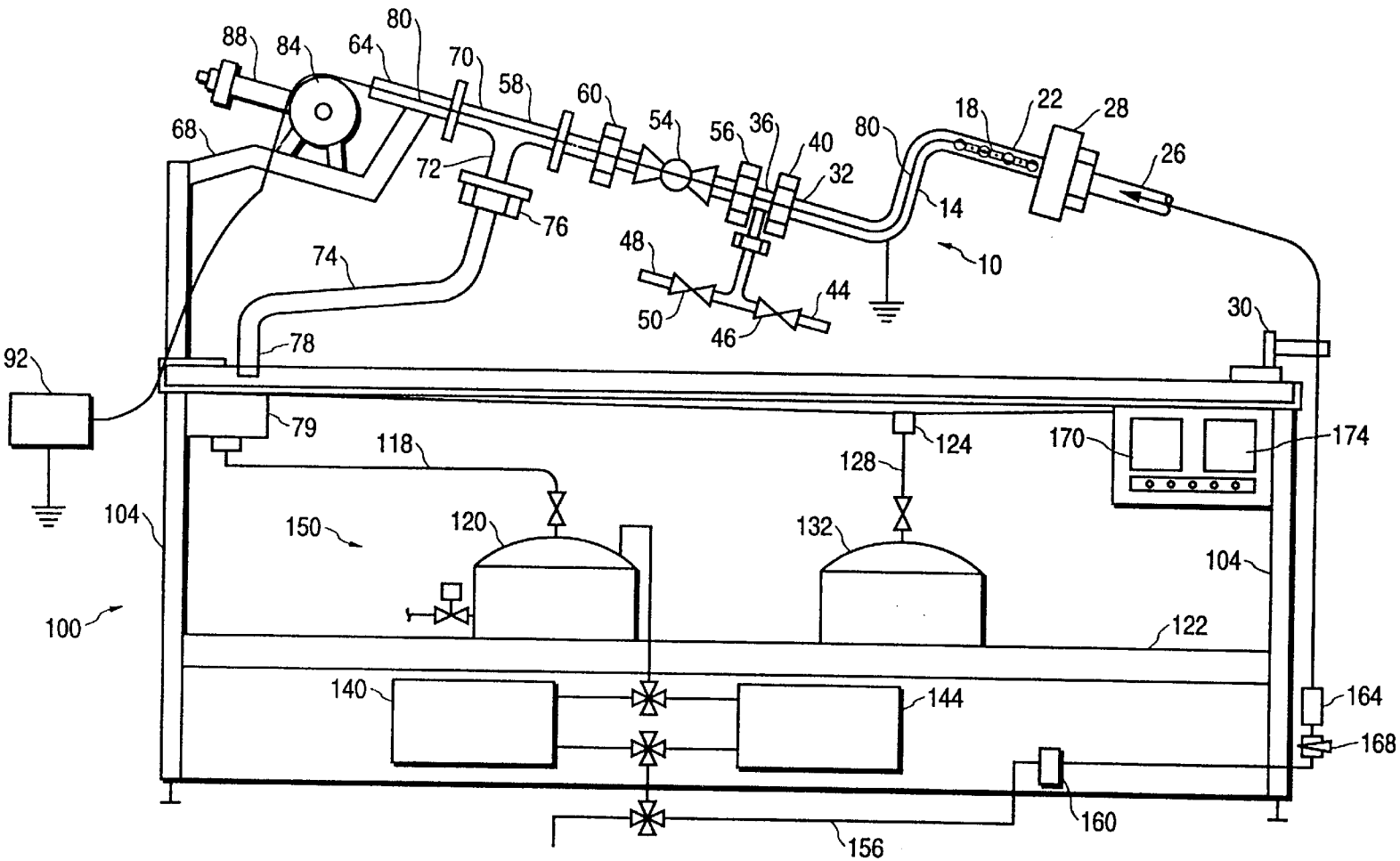
FIG. 1 depicts a preferred embodiment of the tube electropolishing device and method of the present invention.

FIG. 1 is a generalized depiction of a tube electropolishing system 10 of the present invention. As depicted in FIG. 1, a tube 14 having a flexible electrode 18 movably disposed therewithin, is engaged at its upstream end 22 to an electrolyte flow tube 26 utilizing a suitable connector 28. The tube 26 may be stabilized by a support bracket 30. The downstream end 32 of the tube 14 is engaged to a T fitting 36 utilizing an appropriate connector 40. The T fitting 36 is utilized for inletting cleansing water 44 utilizing a valve 46, and clean air 48 utilizing a valve 50, into the tube 14. The T fitting 36 is connected to a shut off valve 54 utilizing a suitable connector 56, and the shut off valve 54 is connected to a further T fitting 58 utilizing a suitable connector 60. The T fitting 58 is fixedly engaged to an adjustable stand 68, such that the top cross member 70 of the T fitting 58 is disposed at an angle of at least 150 degrees from the horizontal for up to approximately a 4 inch diameter tube 14, and the leg 72 of the T fitting 58 depends downwardly. The downstream end 64 of the T fitting 58 is open. An electrolyte return tube 74 is engaged to the leg 72 of the T fitting 58 utilizing an appropriate connector 76. The downstream end 78 of the electrolyte return tube 74 opens into a drain receptacle 79. An electrolyte return line 118 is engaged from the drain 79 to a liquid transfer system 150 which functions to cause electrolyte to flow through the tube electropolishing system 10 from the input electrolyte flow tube 26 to the electrolyte return tube 74. A preferred embodiment of the liquid transfer system 150 is shown and described in copending U.S. patent application Ser. No. 08/777,681 filed Dec. 20, 1996, now U.S. Pat. No. 5,832,948, although other liquid transfer systems that can produce appropriate liquid flow rate parameters can provide adequate results.

The flexible electrode 18 is engaged to a flexible cable 80 which is routed through the T fitting 36, valve 54 and T fitting 58. The cable 80 exits through the open downstream end 64 of the T fitting 58. The cable 80 is engaged to a cable pulling pulley 84 that is driven by a variable speed motor 88, to pull the cable 80 through the tube 14. Electrical power is provided to the cable 80 utilizing a direct current power source 92, and the tube 14 is also connected to the power source 92. The cable 80 is insulated throughout its length (up to the flexible electrode 18) to avoid unwanted shorting out of the cable against the walls of the tube 14. In the preferred embodiment, the power source 92 provides pulsed direct current, the cable 80 is connected to the negative terminal of the power source 92 and the tube 14 is connected to the positive terminal, such that an electropolishing current will be created between the flexible electrode 18 and the inner surface of the tube 14 through the electrolyte flowing within the tube 14, such that the inner surface of the tube 14 will be electropolished.

An apparatus support table 100 having legs 104 and a top surface drain pan 108 is utilized to support the stand 68, drain 79 and the electrolyte supply tube support bracket 30. The drain 79 is piped 118 into an electrolyte holding tank 120 supported by a table shelf 122. The drain pan 108 includes a drain outlet 124 which is piped 128 into a waste liquid holding tank 132 that is supported by table shelf 122.

In the preferred liquid transfer system 150, which is described more fully below with the aid of FIG. 2, the electrolyte is air pressure driven through the electropolishing apparatus 10 utilizing two pressurizable electrolyte supply vessels 140 and 144 that are supported by a stainless steel containment tray 148. The electrolyte supply vessels 140 and 144 receive electrolyte from the electrolyte holding tank 120 through an electrolyte control valve system. Electrolyte from vessels 140 or 144 is driven through a feed line 156, through filters 160 a sensor 164 and a control valve 168 to the electrolyte flow tube 26. Electrolyte flow control devices, including a flow meter 170 and a pH/temperature meter 174, operate through sensor 164 and valve 168 to control the temperature, pH and flow rate of the electrolyte through the system. It is therefore to be understood that electrolyte is caused to flow through the tube 14 from the supply vessels 140 or 144, and that the electrolyte returns through the return tube 74 to the electrolyte holding tank 120.

The device of FIG. 1 is utilized by firstly, fishing the electrode 18 and its attached cable 80 through the tube 14 to the upstream end 22 of the tube 14. Thereafter, the connector 28 is utilized to engage the electrolyte flow tube 26 to the tube end 22. Following engagement of the electrolyte flow tube 26 to the tube 14, the liquid transfer system 150 is activated to cause electrolyte to fill and flow through the tube 14 and drain out into the drain 79.

The power source is next activated, such that a voltage potential is created between the electrode 18 and the inner surface of the tube 14. An electrical current then passes between the electrode 18 and the tube 14 through the electrolyte in the tube, and the inner surface of the tube is electropolished. Utilizing the cable pulling pulley 84, and the variable speed motor 88, the cable is pulled such that the electrode 18 is slowly pulled through the tube 14, electropolishing the interior surface of the tube 14 as it is pulled therethrough.

After the electrode 18 has been pulled entirely through the tube 14 the electrode power is turned off. The electrode 18 is withdrawn past the shut off 54, and the shut off 54 is closed. The electrolyte control valve 68 is open. Thereafter, the air flow valve 50 is opened and air is caused to flow through the tube 14 to push back the remaining electrolyte. Following the electrolyte purge, the water valve 46 is opened and an air valve 50 is closed, such that pressurized water flows through the tube 14 to flush out all remaining electrolyte. Thereafter, air is again caused to flow through tube 14 using valve 50 to dry out the tube. In this manner, the interior surface of the tube is electropolished, cleaned and dried, such that the tube 14 is made available for future use.

Figure 2:
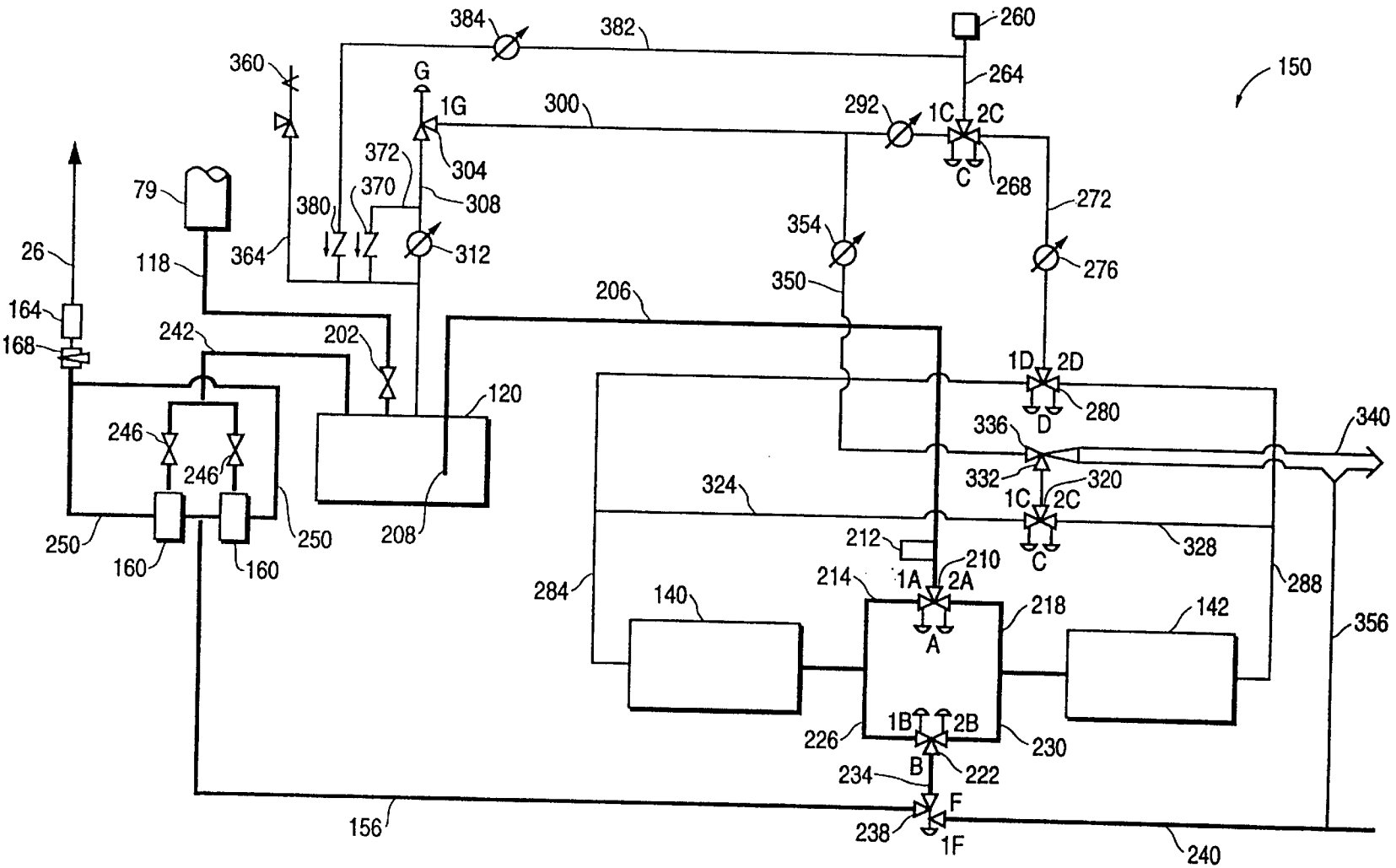
FIG. 2 is a schematic diagram depicting a preferred electrolyte transfer system of the present invention.

FIG. 2 is a detailed depiction of a preferred electrolyte delivery valve system 150 of the present invention, wherein gas pipes are shown as a single line and electrolyte pipes are shown as a double line. As depicted in FIG. 2, an electrolyte drain line 118 delivers electrolyte from the drain receptacle 79 through a valve 202 to the electrolyte holding tank 120. The holding tank 120 is disposed in an elevated position relative to the two supply vessels 140 and 142. An electrolyte supply line 206 is connected from the holding tank 120 to a valve 210 (also identified by the letter A), and the inlet end 208 of line 206 is disposed towards the bottom of tank 120. A liquid sensor 212 in line 206 is used to indicate the presence of liquid in line 206. The valve 210 may be activated to supply electrolyte to vessel 140 through line 214 or to vessel 142 through line 218. Electrolyte from vessel 140 is deliverable to a valve 222 (also identified by the letter B) through line 226, whereas electrolyte from vessel 142 is deliverable to the valve 222 through line 230. Electrolyte from the valve 222 is delivered to electrolyte flow line 234 to a valve 238 (also identified by the letter F). Electrolyte normally flows through the valve 238 to the electrolyte feed line 156 to electrolyte filters 160, but if valve 238 is activated the electrolyte flows to a drain line 240. In the preferred embodiment, two filters 160 are placed in parallel in line 156 to remove unwanted impurities from the electrolyte. An electrolyte bypass line 242 that is accessible utilizing bypass valves 246, can be utilized to recirculate electrolyte from the filters back to the holding tank 120. Electrolyte passing through filters 160 is piped through parallel lines 250 to the electrolyte flow control valve 168 and sensor 164, as has been discussed hereinabove.

The flow of electrolyte from the vessels, 140 and 142 is controlled by gas pressure, preferably but not necessarily using an inert gas such as nitrogen. As depicted in FIG. 2, nitrogen from a source 260 is fed through delivery line 264 to a valve 268 (also identified by the letter E). In a first gating from valve 268, pressurized gas is fed through a line 272 that is controlled by a regulator 276 to a valve 280 (also identified by the letter D). Pressurized gas can then be gated from valve 280 to vessel 140 through gas line 284 or to vessel 142 through gas line 288.

Returning to valve 268, the left hand gating from valve 268 delivers pressurized gas through regulator 292 and line 300 to a gas control valve 304 (also identified by the letter G). Activation of valve 304 allows replacement gas to pass through line 308, through regulator valve 312 to tank 120. It is therefore to be understood that when electrolyte is present in tank 120 and in line 206 and when valve 210 is opened to either vessel 140 or 142, that a siphon effect will cause electrolyte to flow from tank 120 into vessels 140 or 142, and that as valve 268 and 304 are appropriately activated, replacement gas will be inlet into tank 120 to facilitate the siphon flow of electrolyte from tank 120 through line 206 to vessels 140 or 142, thus filling tanks 140 or 142 with electrolyte.

In order to fill vessels 140 or 142 with electrolyte, it is necessary to outlet any gas present in vessels 140 and 142 that is displaced by inletted electrolyte. To accomplish the outletting of gas from vessels 140 and 142, a valve 320 (also identified by the letter C) is engaged by gas lines 324 and 328 to lines 284 and 288 respectively. The valve 320 is preferably connected to the suction orifice 332 of a venturi valve 336 which is connected to a gas exhaust 340. Pressurized gas to operate the venturi valve 336 is delivered through gas line 350 which is connected through a control valve 354 to pressurized gas line 300 that is connected to valve 268. Therefore, when valve 320 is opened it permits the outletting of gas from vessels 140 or 142 during the electrolyte filling of those vessels. Additionally, if the venturi valve 336 is activated, a suction force can be applied through valve 320 to facilitate the removal of displaced gas from vessels 140 and 142. A drain line gas exhaust line 356 is connected between the drain line 240 and the exhaust 340.

The primary means for initiating a siphon from tank 120 is through a vacuum from the line 206. To initiate the vacuum, gas valve 268 is opened and valve 304 is closed to cause pressurized gas to flow through line 350 to the venturi 336. This causes a vacuum to be created from the suction orifice 332 of the venturi valve 336 back to the valve 320. Valve 320 may be opened to either vessel 140 or 142 through line 324 or 328, and when valve 210 is opened to the appropriate line 214 or 218 from vessels 140 or 142 respectively, the vacuum will be created through vessels 140 or 142 to line 206 and back to tank 120. Once a siphon flow is initiated the vacuum effect is discontinued as the gravity induced flow of the siphon will continue to cause fluid movement from tank 120 when required in the system.

An alternating fill-empty process is utilized to transfer electrolyte from the vessels 140 and 142 through valve 222 to line 156. To transfer electrolyte from vessel 140, valves 268 and 280 are appropriately opened to cause pressurized gas to flow through line 284 into vessel 140, and valve 222 is opened to permit electrolyte flow from vessel 140. When vessel 140 is nearly empty, valve 280 is activated to cause pressurized gas to flow through line 288, into vessel 142. Simultaneously, valve 222 is operated to permit electrolyte to flow from vessel 142 into line 156. While electrolyte from vessel 142 is being emptied through line 156, electrolyte from tank 120 is simultaneously caused to fill vessel 140, as has been discussed hereabove. When vessel 142 is nearly empty, valve 280 is activated to cause pressurized gas to flow through line 284, to cause electrolyte to flow from vessel 140, with valve 222 having been appropriately activated to allow electrolyte to flow from vessel 140. While electrolyte flows from vessel 140, vessel 142 is filled. It is therefore to be understood that electrolyte can be constantly transferred through line 156 by alternately filling and emptying vessels 140 and 142. Through appropriate control of the various valves of the liquid transfer system 150, the electrolyte flow rate through line 156 can be constantly maintained. It is to be further appreciated that the electrolyte transfer system 150 does not use reciprocating pumps or other devices that cause a pulsating pressurized electrolyte flow. Rather, the electrolyte transfer system 150 provides a constant electrolyte flow rate that is very controllable at low flow rates through control valve 168.

For gas control and safety reasons a 5 psi check valve 360 is engaged through gas line 364 to the gas delivery line 308 for tank 120. For added safety, a pressure release valve 370 in line 372 provides a safety release across regulator 312, and a pressure release valve 380 in line 382 having regulator 384 disposed therein is also provided.

To provide a fuller understanding of the operation of the electrolyte transfer system 150, a valve table is presented in Table 1 herebelow wherein "O" means open and "C" means closed and wherein "A" refers to valve 210, "B" refers to valve 220, "C" refers to valve 230, "D" refers to valve 280, "E" refers to valve 268, "F" refers to valve 238, and "G" refers to valve 304. The comprehension of the valve settings as set forth in Table 1 will be well understood by those skilled in the art in contemplation of FIG. 2, and a detailed description thereof is therefore unnecessary.

TABLE 1

| | 1A | 1B | 1C | 1D | 2A | 2B | 2C | 2D | 2E | 1G | 1E | No Drum Pressure 1E | Drum Pressure 1E |
|---|---|---|---|---|---|---|---|---|---|---|---|---|---|
| To Fill PV140 | o | c | o | c | c | c | c | c | o | c | c | c | o |
| Fill PV140 | o | c | o | c | c | c | c | c | c | c | c | c | o |
| Press PV140 | c | o | c | o | c | c | c | c | o | c | c | c | c |
| To Fill PV142 | c | c | c | c | o | c | o | c | o | c | c | c | o |
| Fill PV142 | c | c | c | c | o | c | o | c | c | c | c | c | o |
| Press PV142 | c | c | c | c | c | o | c | o | o | c | c | c | c |
| To Reset | c | c | c | c | c | c | o | o | c | o | c | o | c |
| At Reset | c | c | c | c | c | c | c | c | c | o | c | o | c |

□ DEPENDS ON OTHER PRESSURE VESSEL STATUS
c Closed
o Open

Figure 3:
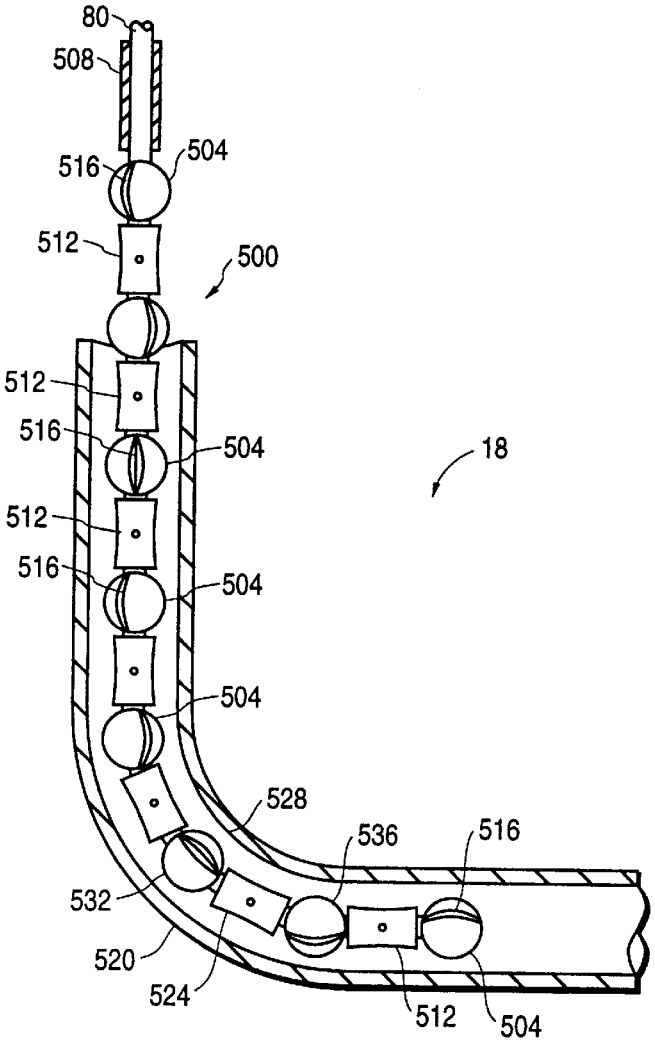
FIG. 3 is a partially cut away view depicting a flexible electrode embodiment of the present invention disposed within a tube.

FIG. 3 is a partially cut away view depicting a first flexible electrode embodiment 500 of the present invention disposed within a metal tube 14 having a 90° bend. As depicted therein, the flexible electrode 500 includes a plurality of spherical insulator members 504 disposed upon an electrical cable 80 having an insulator sheath 508. In the preferred embodiment, the spherical insulators are made from Teflon balls having a bore formed therethrough to slide over the cable 80. A plurality of electrode members 512 are disposed upon the cable 80 in an alternating relationship between the insulator balls 504, such that a chain of alternating insulator, electrode members is created. The diameter of the insulator balls 504 is less than the inner diameter of the tube 14, such that electrolyte within the tube 14 can flow past the electrode 18. Alternatively, the balls 504 can have one or more grooves 516 cut into the surface to facilitate electrolyte flow passage. The size and shape of the electrodes 512 is controlled by several factors. Firstly, the closer that the outer surface of an electrode 512 is to the inner wall of the tube 14, the stronger will be the electropolishing current and effect. Secondly, the outer surface of an electrode 512 must not touch the wall of the tube 14 or an electrical short will occur. Thirdly, when the electrode embodiment 500 is drawn through a bend 520 in the pipe 14, the outer surface of each electrode, such as electrodes 524, passing through the elbow 528 in the bend 520 will more closely approach the inner wall of the tube 14. The diameter of the tube 14, radius of curvature of the centerline of the bend 520, coupled with the distance between adjacent insulators 532 and 536, as well as the diameters of the insulators 532 and 536, and the shape and diameter of the electrode 524, are all factors that will determine whether the electrode 524 will short out by touching the inner surface of the tube 14 in the elbow 528 of the bend 520.

Figure 4:
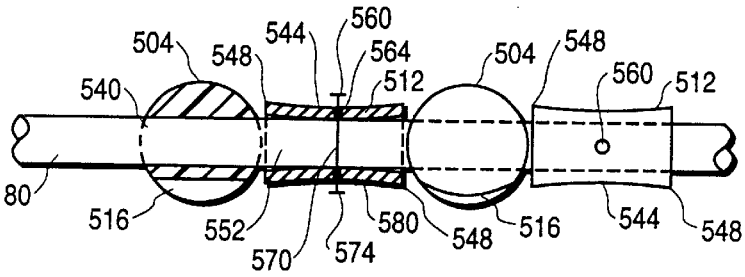
FIG. 4 is an enlarged partially cross-sectional side elevational view of the flexible electrode embodiment of FIG. 3 of the present invention.

FIG. 4 is an enlarged partially cross-sectional view of the flexible electrode 500 of FIG. 3, depicting the shape and attachment of the electrodes 512 and the spherical insulators 504 to the electrical cable 80. As depicted in FIG. 4, a cylindrical bore 540 projects diametrically through each spherical insulator 504, such that the electrical cable 80 passes therethrough. Each electrode member 512 has a generally thin walled cylindrical body portion 544 with outwardly flared ends 548 that approach the surface of the spherical insulators 504. A cable bore 552 projects through the body portion 544 such that the electrical cable 80 may pass therethrough. To hold the electrode 512 in position upon the cable 80 and pass electric current, a cable engagement pin 560 is passed through a hole 564 in the body portion 544 of the electrode 512, and through a bore 570 formed through the electrical cable 80. The end 574 of the pin 560 is then passed through a hole 580 in the electrode body portion 544 that is diametrically opposite hole 564. The ends of the pin 560 are flattened and/or soldered to maintain the pin 560 in position and to hold the electrode 512 in position on the cable 80. The flared ends 548 project more closely to the inner surface of the tube 14 to increase the electropolishing effect, while the proximity of the spherical insulator to the flared ends prevents contact of the flared ends with the tube side wall when the electrode assembly 500 is drawn through a bend in the tube 14. The electrode embodiment 500 is generally suitable for electropolishing tubes having an inner diameter of at least 0.075 inches. A preferred embodiment for a 1.0 inch outer diameter tube having approximately an 0.875 inch inner diameter, comprises an electrode assembly 500 including spherical Teflon insulators having a diameter of approximately 0.75 inches and copper electrodes 512 having a center body 544 diameter of approximately 0.50 inches and a flared portion diameter of approximately 0.65 inches, where the distance between center points of the insulators is approximately 2.0 inches.

Figure 5:
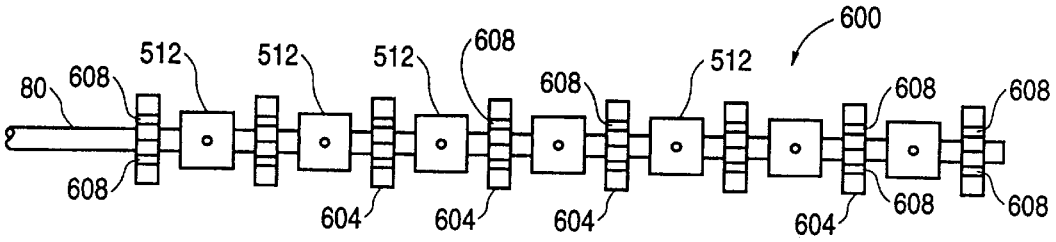
FIG. 5 is a side elevational view of an alternative flexible electrode embodiment of the present invention.
Figure 6:
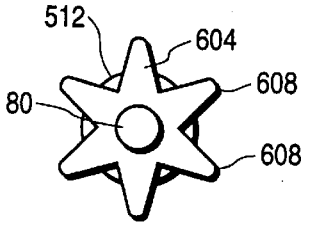
FIG. 6 is an end elevational view of the alternative flexible electrode embodiment of FIG. 5 of the present invention.

FIGS. 5 and 6 depict a second flexible electrode embodiment 600 of the present invention, wherein FIG. 5 is a side elevational view and FIG. 6 is an end elevational view. The significant differences between flexible electrode 600 and flexible electrode 500 depicted in FIGS. 3 and 4 is the replacement of the spherical insulator members 504 of embodiment 500 with star-shaped insulating washers 604 of embodiment 600, and the replacement of the flared ended cylindrical electrodes 512 with straight walled cylindrical electrodes 606, as shown in FIGS. 5 and 6. As is seen in FIG. 5, a star-shaped insulating washer 604 is disposed between each electrode member 606. In the preferred embodiment, each star-shaped insulator 604 has six points 608, however, insulators with more or less points are certainly utilizable in place thereof. The outer diameter or distance from opposing points 608 of the star-shaped insulator 604 may more closely approach the inner diameter of the tube 14, in that electrolyte will flow past the star-shaped electrode in the spaces between the electrode points 608, whereas an appropriate clearance must be provided between the spherical insulators 504 and the inner wall of the tube 14 to allow electrolyte to flow in the embodiment 500 depicted in FIG. 3. The cylindrical electrodes 606 are formed with thin side walls that define a central passageway for the cable 80. A cable engagement pin 612 is passed through holes formed in the side wall of the electrode 606 and through the cable 80, in a similar manner to the engagement of electrodes 512 to the cable 80 depicted and described hereabove with the aid of FIG. 4. The embodiment 600 is generally suitable for electropolishing tubes having an inner diameter that is greater than 0.75 inches, and it has dimensions that generally approximate those of embodiment 500.

Figure 7:
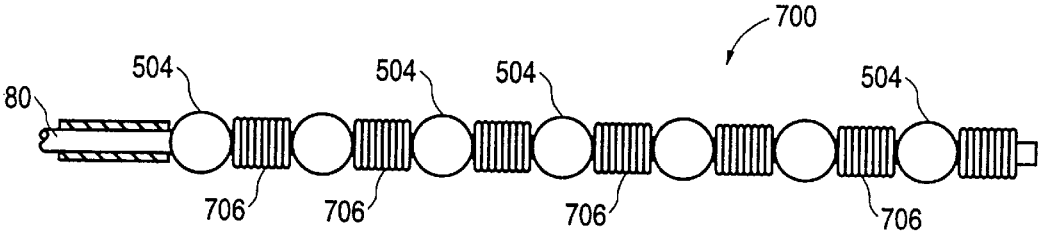
FIG. 7 is a side elevational view of another alternative flexible electrode embodiment of the present invention.

FIG. 7 is a side elevational view depicting a third flexible electrode embodiment 700 of the present invention. As depicted therein, a plurality of spherical insulators 504, that are identical to insulators 504 described hereinabove with regard to electrode embodiment 500, are disposed upon an electrical cable 80. Electrically conductive wire 706 is wound in a spiral fashion upon the cable 80 between each spherical insulator 504. The spiral wound wire 706 makes electrical contact with the cable 80, and serves both as an electrode that is disposed between each spherical insulator 504 and as a spacer to maintain proper spacing between the insulators 504. Owing to the flexible nature of the spiral wrapped electrode 706, the electrode 700 will retain good flexibility in passage through bends in a tube such as tube 14 depicted in FIG. 3. The electrode embodiment 700 is particularly suited for smaller tubes having an outer diameter of approximately 0.25 inches. A preferred embodiment for a 0.25 inch outer diameter tube having a 0.18 inch inner diameter comprises an electrode assembly 700 including spherical Teflon insulators having a diameter of approximately 0.156 inches and wound copper wire electrodes having a diameter of approximately 0.10 inches, where the distance between center points of the insulators is approximately 0.45 inches.

Figure 8:
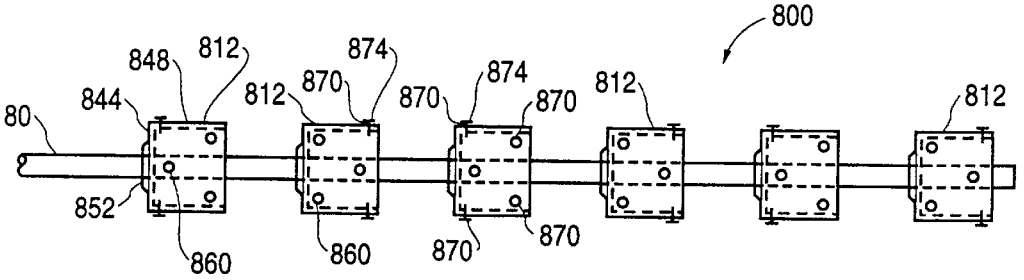
FIG. 8 is a side elevational view of a further alternative flexible electrode embodiment of the present invention.

Still another flexible electrode embodiment is depicted in a side elevational view in FIG. 8. As depicted in FIG. 8, electrode embodiment 800 includes a plurality of cup-shaped cylindrical electrodes 812. Each electrode 812 includes a base wall 844 and generally cylindrical side walls 848, and a hole 852 is formed through the base wall 844 to permit the passage of the electrical cable 80 therethrough. A cable engagement pin 860 is passed through cable 18 and is soldered to base wall 844 to fixedly engage the electrode 812 to the cable 80. A plurality of insulating members 870 having broadened heads 874 project outwardly from the side walls 848. The heads of the insulator members 870 act as spacers to prevent the side wall 848 of the electrode 812 from touching the inner surface of a tube, such as to tube 14 depicted in FIG. 3. This electrode embodiment 800 is particularly suited to larger tubes having a diameter of approximately 1.5 inches or more.

Figure 9:
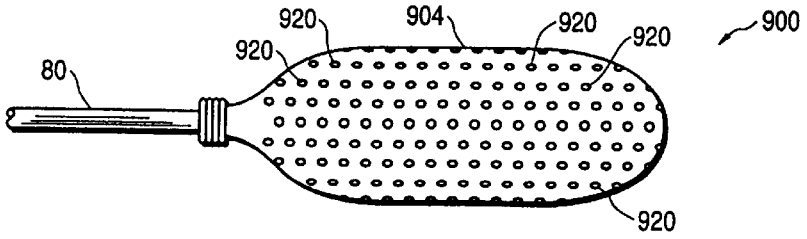
FIG. 9 is a side elevational view of yet another alternative flexible electrode embodiment of the present invention.
Figure 10:
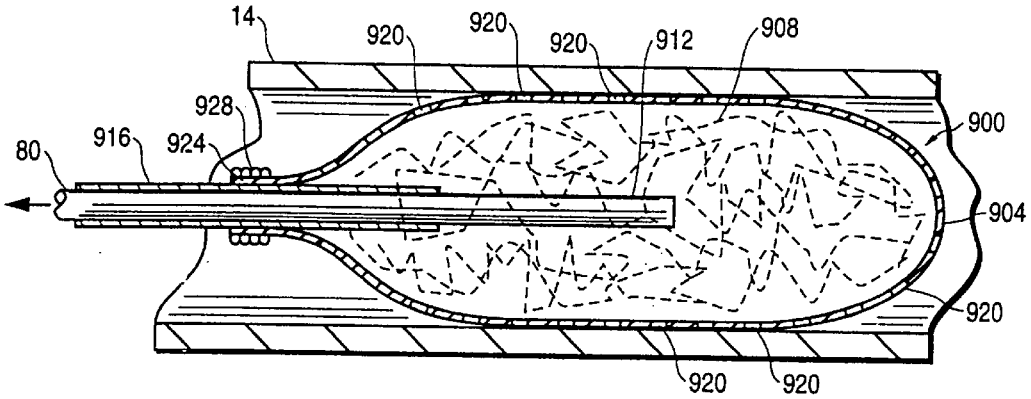
FIG. 10 is a side cross-sectional view of the electrode embodiment of FIG. 9 disposed within a section of metal tubing.

Still a further flexible electrode embodiment 900 is depicted in FIGS. 9 and 10, wherein FIG. 9 is a side elevational view and FIG. 10 is a cross-sectional view of the embodiment 900 disposed within a metal tube 14. As depicted in FIGS. 9 and 10, the electrode embodiment 900 is formed with a flexible covering 904 which encloses a quantity of electrically conductive metallic wool material 908, which is copper wool in the preferred embodiment. The metallic wool 908 is electrically interconnected with the exposed end 912 of the electrical cable 80 which is covered with an insulating sheath 916 throughout its length except for the exposed end 912. The flexible covering 904 is preferably formed from a thin walled Teflon sock, and a plurality of perforations 920 are formed through the wall of the flexible covering 904. The forward end 924 of the flexible covering 904 is engaged to the cable 80 by a means such as a tightly wound thin wire 928. While the preferred flexible covering 904 is a perforated Teflon sock, other expanded or perforated covering materials may be utilized that can survive the electro-chemical and thermo-chemical reactions which occur during the tube electropolishing process. The perforations 920 are significant in that they facilitate the ingress and egress of electrolyte through the flexible covering 904 to accomplish the electropolishing effect of the electrode embodiment 900. It is significant to note that the flexible nature of the covering 904 and metallic wool 908 permits the electrode 900 to travel through bends in the tube 14 without the concern of the previously disclosed embodiments that the electrically active components of the electrode might touch the side of the tube 14 and cause an electrical short. This embodiment 900 is particularly suitable for tubes having a diameter that is greater than approximately 0.5 inches.

Figure 11:
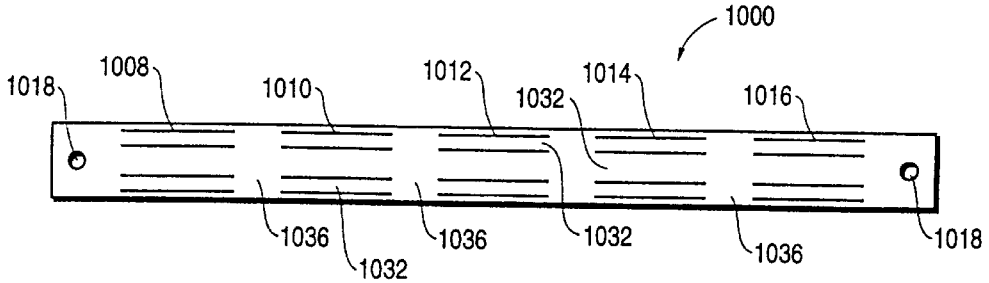
FIG. 11 is a side elevational view of yet a further alternative flexible electrode embodiment of the present invention.
Figure 12:
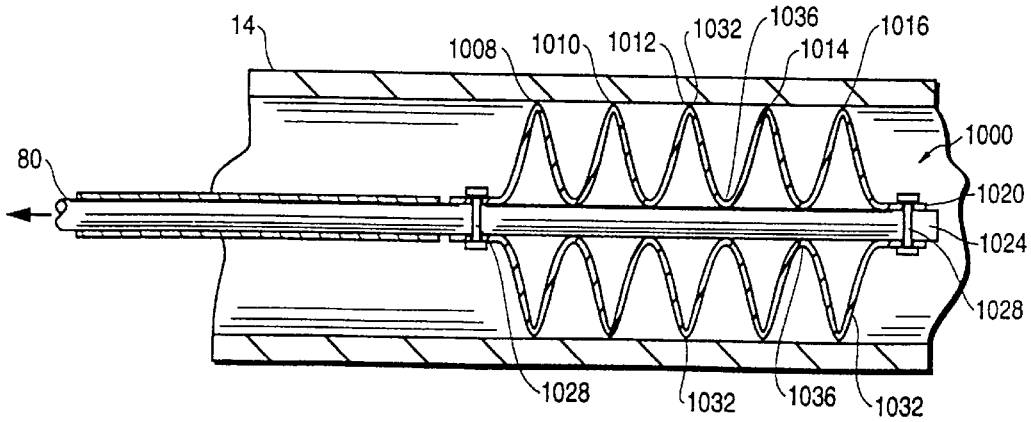
FIG. 12 is a side cross-sectional view of the electrode embodiment of FIG. 11, depicted within a section of metal tubing.

FIGS. 11 and 12 depict yet another flexible electrode embodiment 1000 of the present invention, wherein FIG. 11 is a side elevational view of a cylindrical insulator a member 1004 before it is compressed and mounted on an electrode cable 80, and FIG. 12 is a cross-sectional view depicting the electrode 1000 disposed within a tube 14 for electropolishing purposes. As depicted in FIGS. 11 and 12, the electrode embodiment 1000 comprises a generally cylindrical insulating member 1004 disposed upon the exposed distal end 1024 of an electrical cable 80. The insulating member 1004 is defined by a flexible, thin sidewall 1006 and having several sets of slits 1008, 1010, 1012, 1014 and 1016 formed through the sidewall 1006. Each of the sets of slits, such as set 1010, includes several slits that are parallel to the central axis of the cylindrical sidewall 1006 and circumferentially disposed around the surface of the sidewall 1006. An engagement hole 1018 is formed through the sidewall 1006 at each end of the insulating member 1004.

FIG. 12 depicts the insulating member 1004 engaged with a electrode cable 80 and disposed within a tube 14. As is seen in FIG. 12, the insulating member 1004 is mounted upon the exposed end 1024 of the cable 80 in an axially compressed manner. Mounting pins 1028, that are preferably non-electrically conductive, are passed through the mounting holes 1018 and through the exposed cable end 1024 to hold the member 1004 in a fixed, compressed position. As can be seen in FIG. 12, when the member 1004 is axially compressed, the sidewall material 1032 within the slits in each slit set 1008–1016 is caused to project outwardly, whereas the material in the unslitted sidewall portions 1036 between the slit sets 1008–1016 remains generally cylindrical. It is therefore to be understood that the axial compression of the slitted member 1004 produces a plurality of outwardly projecting portions 1032 around the circumference of the member 1004. The insulating member 1004 is formed from an electrically non-conductive material that can withstand the electrochemical and thermo-chemical conditions of the electropolishing reaction, and an expanded Teflon tube has been found to produce good results. This embodiment 1000 is particularly suited to tubes having a diameter of approximately 1.0 inches or more. In a preferred electrode embodiment 1000, for a 2 gage cable and a 1.5 inch diameter metal tube, a Teflon insulating member 1004 is preferably formed utilizing a Teflon tube having a length of approximately 17 inches, an outside diameter of approximately 0.5 inches, a wall thickness of 0.065 inches, and 6 sets of slits, wherein each set of slits is approximately 2.5 inches long, 8 slits are formed circumferentially around the member 1004, and a spacing of 0.5 inches is made between each set of slits. In use, the length of the insulating member 1004 is compressed to approximately 14 inches. A specific utilization of the embodiment 1000 in a 1.5 inch diameter metal tube includes an electrolyte flow rate of approximately 2 gallons per minute with the application of a 300 amp. current and an electrode pull rate of approximately 5 inches per minute.

As will be appreciated by those skilled in the art, when the electrode embodiment 1000 is pulled through a bend in a tube 14, the various flexible members 1032 are free to flex and to move axially to some degree, such that the exposed cable end 1024 can be pulled through a bend without electrical contact between the cable end 1024 and the sidewall of the tube 14, thus preventing the electrical shorting of the electrode against the inner wall of the tube 14 when the electrode 1000 passes through a bend in the tube 14. Additionally, the flexible nature of the members 1032 permits the device 1000 to pass through smaller openings of component parts that are found in many tubular systems. After the electrode 1000 and its collapsed flexible members 1032 are pulled through a small opening, the flexible members 1032 will expand into a larger diameter section of the tubing.

While the invention has been depicted and described with reference to several preferred embodiments, it will be understood by those skilled in the art that modifications and changes may be made therein while retaining the spirit and scope of the invention. It is therefore intended that the following claims include all such changes and modifications that include the true spirit and scope of the invention.

What we claim is:

1. An apparatus for electropolishing the interior surface of a section of electrically conductive tubing, comprising:

an electrolyte delivery means being connectable to a first end of said section of tubing for causing an electrolyte to flow through said tubing;

an electropolishing electrode means being electrically engaged to a length of electrically conductive cable and being adapted for disposition within said section of tubing;

an electrical power supply means being electrically connected to said section of tubing and to said cable and functioning to provide electrical current for passage through said electrode means, said electrolyte and said section of tubing for electropolishing an interior wall of said tubing;

an electrode pulling means being engaged to said cable and functioning to pull said electrode means through said section of tubing; and wherein said electrode means includes a plurality of electrode members being fixedly disposed upon said cable and being electrically connected thereto;

a plurality of insulator members being fixedly engaged to said electrical cable; at least one of said insulator members being disposed between each of said electrode members, such that said insulator members and said electrode members are generally alternately disposed upon said electrical cable to form a chain of insulator and electrode members, and wherein a first member in said chain is an insulator member and a last member in said chain is an insulator member;

at least one of said insulator members having an electrolyte passage means, including at least one indented portion formed into said insulator member, and functioning to allow an electrolyte to more easily flow past said insulator member during a tube electropolishing process.

2. An apparatus as described in claim 1 wherein at least one said insulator is shaped as a sphere, and said electrolyte passage means comprises at least one slot formed in an outer surface of said sphere.

3. An electrode as described in claim 2 wherein at least one said electrode member is shaped as a tubular member having outwardly flared end portions.

4. An apparatus as described in claim 1 wherein at least one of said insulators is disk shaped, and wherein said electrolyte passage means includes at least one slot cut in an outer surface of said disk.

5. An apparatus as described in claim 1 wherein at least one said insulator member is formed with a plurality of laterally projecting arm portions.

6. An apparatus as described in claim 1 wherein at least one said electrode member is shaped as a cylinder.

7. An apparatus as described in claim 1 wherein at least one said electrode is shaped as a tubular member having outwardly flared end portions.

8. An apparatus for electropolishing the interior surface of a section of electrically conductive tubing, comprising:

an electrolyte delivery means being connectable to a first end of said section of tubing for causing an electrolyte to flow through said tubing;

an electropolishing electrode member being electrically engaged to a length of electrically conductive cable and being adapted for disposition within said section of tubing, said electrode member including a quantity of flexible strands of electrically conductive material, and an insulating member including a thin walled membrane, said insulating member being shaped to enclose said electrode member and being engaged to said cable; said membrane having a plurality of perforations formed therein for the ingress and egress of said electrolyte therethrough;

an electrical power supply means being electrically connected to said section of tubing and to said cable and functioning to provide electrical current for passage through said electrode means, said electrolyte and said section of tubing for electropolishing an interior wall of said tubing; and an electrode pulling means being engaged to said cable and functioning to pull said electrode means through said section of tubing.

9. An apparatus for electropolishing the interior surface of a section of electrically conductive tubing, comprising:

an electrolyte delivery means being connectable to a first end of said section of tubing for causing an electrolyte to flow through said tubing;

an electropolishing electrode means including an uninsulated length of electrically conductive cable being adapted for disposition within said section of tubing, and an insulator member including a generally cylindrical, thin walled tubular member having a plurality of sets of slits formed in said wall thereof, and an engagement means functioning to engage said insulator to said uninsulated length of said cable;

an electrical power supply means being electrically connected to said section of tubing and to said cable and functioning to provide electrical current for passage through said electrode means, said electrolyte and said section of tubing for electropolishing an interior wall of said tubing; and an electrode pulling means being engaged to said cable and functioning to pull said electrode means through said section of tubing.

10. An apparatus as described in claim 9 wherein said insulator member is axially compressible, such that portions of said wall proximate said sets of slits project laterally upon the axial compression of said member.

11. An electrode as described in claim 10 wherein said insulator member is axially compressible, such that portions of said wall proximate said sets of slits project laterally upon the axial compression of said member.

12. An electrode for electropolishing an interior surface of a section of electrically conductive tubing, comprising:

a length of electrically conductive cable;

a plurality of electrode members being fixedly engaged to said cable and being electrically connected thereto;

a plurality of insulator members being fixedly disposed upon said electrical cable; at least one of said insulator members being disposed between each of said electrode members, such that said insulator members and said electrode members are generally alternately disposed upon said electrical cable to form a chain of insulator and electrode members, and wherein a first member in said chain is an insulator member and a last member in said chain is an insulator member; at least one of said insulator members having an electrolyte passage means, including at least one indented portion formed into said insulator member, and functioning to allow an electrolyte to more easily flow past said insulator during a tube electropolishing process.

13. An electrode as described in claim 12 wherein at least one said insulator is shaped as a sphere, and said electrolyte passage means comprises at least one slot formed in an outer surface of said sphere.

14. An electrode as described in claim 12 wherein at least one of said insulators is disk shaped, and wherein said electrolyte passage means includes at least one slot cut in an outer surface of said disk.

15. An electrode as described in claim 12 wherein at least one said insulator member is formed with a plurality of laterally projecting arm portions.

16. An electrode as described in claim 12 wherein at least one said electrode member is shaped as a cylinder.

17. An electrode for electropolishing an interior surface of a section of electrically conductive tubing, comprising:

an electrically conductive cable;

an electrode member being electrically connected to said cable, said electrode member including a quantity of flexible strands of electrically conductive material;

an insulating member including a thin walled membrane; said insulating member being shaped to enclose said electrode member, and being engaged to said cable; said membrane having a plurality of perforations formed therein for the ingress and egress of a liquid electrolyte therethrough.

18. An electrode for electropolishing an interior surface of a section of electrically conductive tubing, comprising:

an electrically conductive cable having an exposed distal end;

an insulator member including a generally cylindrical, thin walled tubular member having a plurality of sets of slits formed in said wall thereof, and an engagement means functioning to engage said insulator to said distal end of said cable.

* * * * *